US005412154A

United States Patent [19]

Takeda et al.

[11] Patent Number: 5,412,154

[45] Date of Patent: May 2, 1995

[54] TONE COLOR CONTROL APPARATUS FOR MUSICAL TONE SIGNAL PRODUCER

[75] Inventors: Fumiteru Takeda; Ojima Fumihiko, both of Hamamatsu, Japan

[73] Assignee: Yamaha Corporation, Japan

[21] Appl. No.: 4,416

[22] Filed: Jan. 14, 1993

[30] Foreign Application Priority Data

Jan. 14, 1992 [JP] Japan ..... 4-005228

[51] Int. Cl.[6] ..... G10H 1/06

[52] U.S. Cl. ..... 84/622

[58] Field of Search ..... 84/622–625

[56] References Cited

U.S. PATENT DOCUMENTS 3,897,709 8/1995 Hiyoshi et al. .

4,773,294 9/1988 Iizuka et al. ..... 84/622

5,260,508 11/1993 Bruti et al. ..... 84/622

FOREIGN PATENT DOCUMENTS 63-28477 8/1988 Japan .

3-120594 5/1991 Japan .

*Primary Examiner*—Stanley J. Witkowski

*Attorney, Agent, or Firm*—Graham & James

[57] ABSTRACT

A tone color control apparatus for a musical tone signal producer has a first memory and a second memory. The first memory memorizes plural sets of tone color data for control of each tone color of plural different musical tone signals produced at the musical tone signal producer. The second memory memorizes plural sets of index data for indexing the plural sets of tone color data and also memorizes plural sets of modification data respectively corresponding with each set of index data. A desired set of the memorized index data and the corresponding set of the modification data are simultaneously read out from the second memory under control of tone color selection by a player. The tone color data are also read out from the first memory under control of the read out index data. The read out tone color data are modified based on the read out modification data to be applied to the musical tone signal producer for controlling a tone color of a musical tone signal produced therefrom.

9 Claims, 13 Drawing Sheets

TONE COLOR CONTROL APPARATUS FOR MUSICAL TONE SIGNAL PRODUCER

BACKGROUND OF THE INVENTION

1. Field of the Invention

The present invention relates to a tone color control apparatus for controlling a tone color of a musical tone signal produced at a musical tone signal producer.

2. Description of the Prior Art

In Japanese Patent Application Laid-Open No. 3-120594 and Japanese Utility Model Publication No. 63-28477, there is disclosed a tone color control apparatus having a memory for memorizing plural sets of tone color data and an editor for editing the tone color data memorized in the memory, wherein each set of the tone color data is read out from the memory and applied to a musical tone signal producer for controlling each tone color of different musical tone signals produced therefrom under modification of the tone color data by the editor. It is, therefore, obliged for a player to edit the tone color data whenever he needs various musical tone signals each tone color of which is slightly different.

U.S. Pat. No. 3,897,709 discloses a tone color control apparatus having plural sets of preset memories each comprised of a plurality of fixed resisters and a set of variable memories comprised of a plurality of variable resisters, wherein one of the plural sets of preset memories is selected by a player to produce a set of voltage control signals, and wherein the voltage control signals are modified by a set of modification voltage signals from the set of variable memories and applied to a musical tone signal producer for controlling a tone color of the musical tone signal produced therefrom under control of the modified voltage control signals. In this case, it is also obliged for a player to manipulate the variable resisters for producing various musical tone signals slightly different in their tone colors. Moreover, the tone color control apparatus becomes relatively large in size due to provision of the fixed and variable resistors.

SUMMARY OF THE INVENTION

Accordingly, it is an object of the present invention to provide an improved tone color control apparatus capable of modifying the tone color data in a simple manner for controlling each tone color of different musical tone signals produced at the musical tone signal producer.

It is another object of the present invention to provide an improved tone color control apparatus, having the above mentioned characteristics, capable of effecting various modifications of the tone color data by means of a memory of relatively small capacity.

It is a further object of the present invention to provide an improved tone color control apparatus capable of effecting various and proper control of a tone color of a single musical tone signal or each tone color of plural musical tone signals produced from the musical tone signal producer at a plurality of different modes.

According to the present invention, there is provided a tone color control apparatus for controlling a tone color of a musical tone signal produced at a musical tone signal producer, the tone control apparatus comprising first memory means for memorizing plural sets of tone color data for control of each tone color of plural different musical tone signals produced at the musical tone signal producer, second memory means for memorizing plural sets of index data for indexing the plural sets of the memorized tone color data and for memorizing plural sets of modification data respectively corresponding with each set of the memorized index data, selection means for simultaneously selecting a desired set of the memorized index data and a set of the memorized modification data, corresponding with the desired set of the memorized index data means for reading out the desired set of the memorized index data and the set of the memorized modification data from the second memory means under control of the selection means and for reading out a set of the memorized tone color data indexed by the desired set of the read out index data from the first memory means, and modification means for modifying the set of the read out tone color data on basis of the set of the read out modification data and for applying the set of the modified tone color data to the musical tone signal producer.

In a preferred embodiment of the present invention, the tone color control apparatus for a musical tone signal producer further comprises edit means for editing the plural sets of the modification data memorized in the second memory means.

In a further preferred embodiment of the present invention, the musical tone signal producer comprises a tone wave form generator circuit for generating a tone wave form signal therefrom, a filter circuit for modifying harmonic composition of the tone wave form signal, an envelope control circuit for controlling an amplitude envelope of the tone wave form signal and an effector circuit for applying a musical effect to the wave form signal wherein, the tone color data memorized in the first memory means include wave form designation data to be applied to the tone wave form generator circuit for designating the tone wave form signals, filter control data applied to the filter circuit for determining a frequency characteristic thereof, envelope control data to be applied to the envelope control circuit for determining a shape of an amplitude envelope of the tone wave form signal and effect control data to be applied to the effector circuit for control of the musical effect applied to the tone wave form signal, and wherein the modification data memorized in the second memory means include data for modifying each of the filter control data, envelope control data and effect control data.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
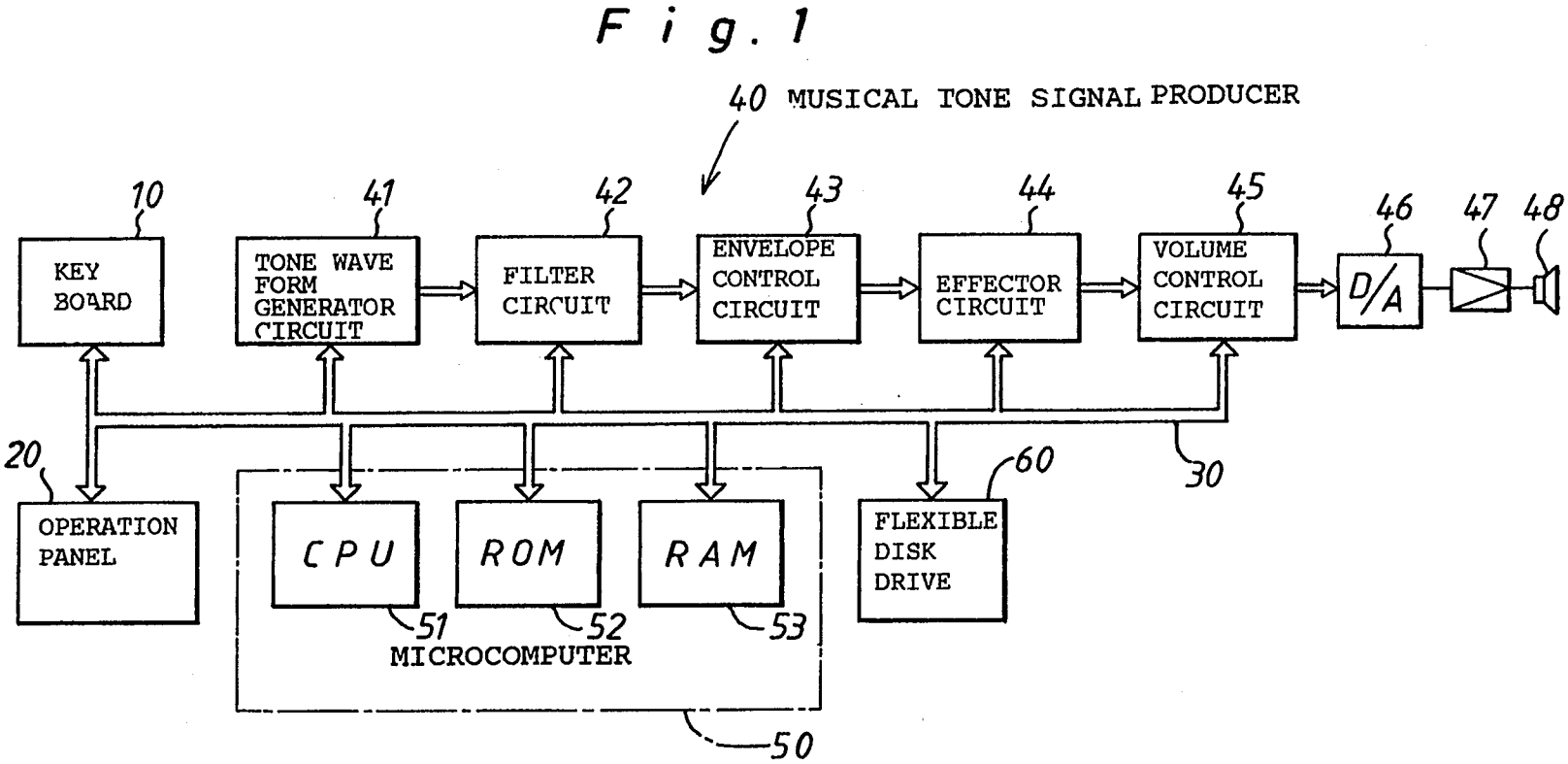
FIG. 1 is a block diagram of an electronic musical instrument provided with a tone color control apparatus for a musical tone signal producer in accordance with the present invention.
Figure 2:
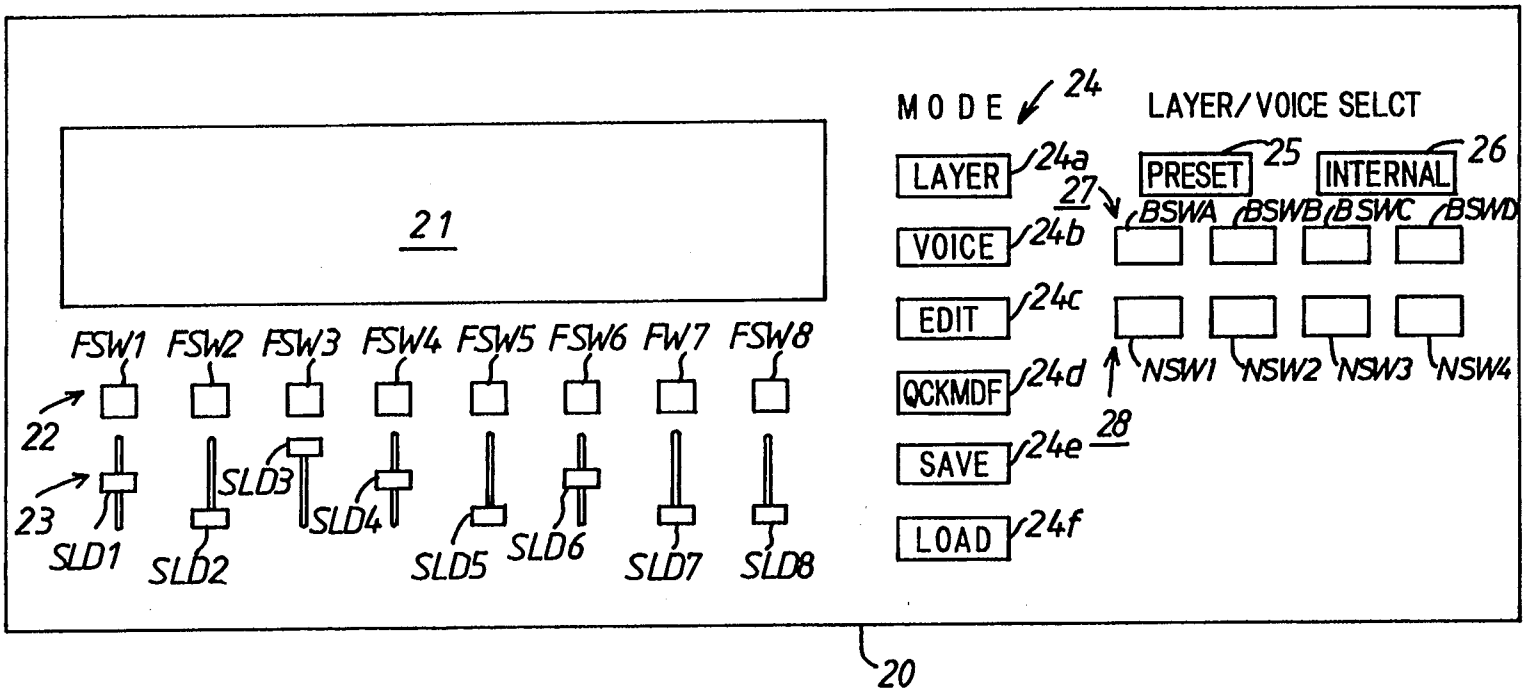
FIG. 2 is an enlarged plan view of operation panel shown in FIG. 1.

In FIG. 1 of the drawings, there is diagrammatically illustrated an electronic musical instrument provided with a tone color control apparatus for a musical tone signal producer. The electronic musical instrument has a key board 10 and an operation panel 20. The key board 10 is provided thereon with a plurality of keys for designating tone pitches and with a plurality of sensors corresponding with the keys for sensing key touches. As shown in FIG. 2, the operation panel 20 is provided thereon with a display 21, a set of function switches 22, a set of slide switches 23, a set of mode switches 24, a preset switch 25, an internal switch 26, a set of bank switches 27 and a set of number switches 28 to designate tone colors of tone signals to be generated. The display 21 indicates a selected operation mode of the electronic musical instrument and selected tone colors. The set of function switches 22 are in the form of eight function switches FSW1–FSW8 arranged adjacent the display 21 and positioned to correspond with each position of various tone control parameters indicated on its screen. The set of slide switches 23 are in the form of eight slide type switches corresponding with the eight function switches FSW1–FSW8 to be used for respectively inputting data indicative of their nob positions. A set of mode switches 24 are in the form of a layer switch 24*a*, a voice switch 24*b*, an edit switch 24*c*, a quick modification switch 24*d*, a save switch 24*e* and a load switch 24*f* to designate one of various modes for processing tone color data. The preset switch 25 designates tone color data memorized in unchangeable condition, and the internal switch 26 designates tone color data memorized in changeable condition. The set of bank switches 27 and the set of number switches 28 are respectively in the form of four bank switches BSWA–BSWD and four number switches NSW1–NSW4 to designate each set of tone color data.

As shown in FIG. 1, the key board 10 and operation panel 20 are connected to a bus line 30 which is connected to a musical tone signal producer 40, a microcomputer 50 and a flexible disk drive 60. The musical tone signal producer 40 includes a tone wave form generator circuit 41 for generating tone wave form signals therefrom, a filter circuit 42 for modifying harmonic composition of the tone wave form signals, an envelope control circuit 43 for controlling amplitude envelopes of the tone wave form signals, an effector circuit 44 for applying musical effects such as reverberation, tremolo or the like to the tone wave form signals and a volume control circuit 45 for controlling mixing ratio and total volume of the tone wave form signals. The output of volume control circuit 45 is connected to a speaker 48 through a D/A converter 46 and an amplifier 47.

Figure 3A:
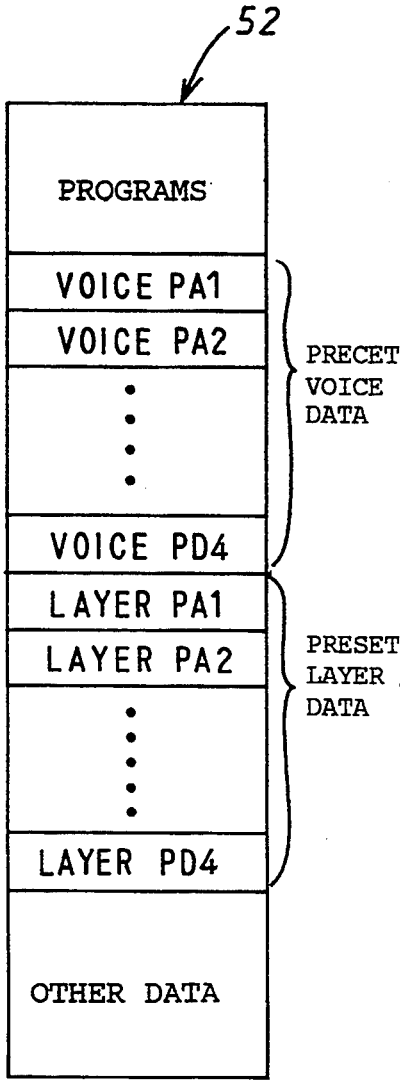
FIG. 3A is an illustration of a memory map of ROM shown in FIG. 1.

The microcomputer 50 includes CPU 51, ROM 52 and RAM 53. The CPU 51 executes control programs for control of tone colors and for generating tone wave form signals from the tone wave form generator circuit 41. The ROM 52 is divided into a first area for memorizing the control programs, a second area for memorizing sixteen sets of preset voice data VOICE PA1, VOICE PA2 . . . VOICE PD4 and sixteen sets of preset layer data LAYER PA1, LAYER PA2 . . . LAYER PD4 corresponding with each combination of the bank switches BSWA–BSWD and the number switches NSW1–NSW4 and a third area for memorizing other data such as data for controlling total volume level as shown in FIG. 3A.

Figure 4A:
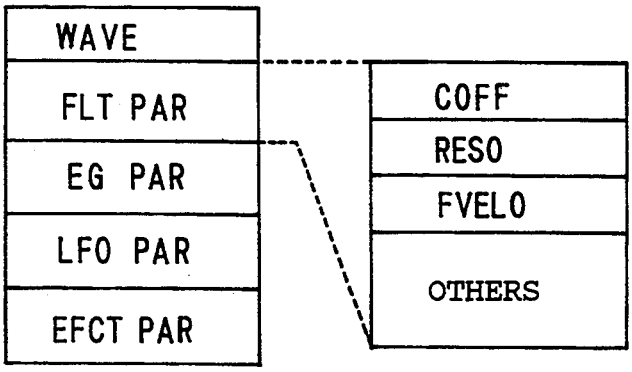
FIG. 4A is an Illustration of data format of a set of voice data shown in FIG. 3A and 3B.

As shown in FIG. 4A, the sixteen sets of preset voice data VOICE PA1, VOICE PA2 . . . VOICE PD4 each are comprised of data WAVE for designating one of tone wave form signals memorized in the tone wave form generator circuit 41, parameters FLTPAR for determining a frequency characteristic of the filter circuit 42, parameters EGPAR for determining a shape of amplitude envelope formed at the envelope control circuit 43, parameters LFOPAR for modulating the tone wave form signal with a low frequency signal and parameters EFCTPAR for controlling an acoustic effect such as a reverberation effect and a tremolo effect at the effector circuit 44. These parameters FLTPAR, EGPAR, LFOPAR, EFCTPAR are further comprised of various data respectively. For example, the parameters FLTPAR are comprised of data COFF for defining a cut-off frequency (or a resonance frequency), data RESO for defining resonance sharpness, data FVELO for defining sensitivity of key touch control used for filter characteristic control and other data for selecting a type of filter (one among a high pass filter, a low pass filter and a band pass filter) in the filter circuit 42.

Figure 4B:
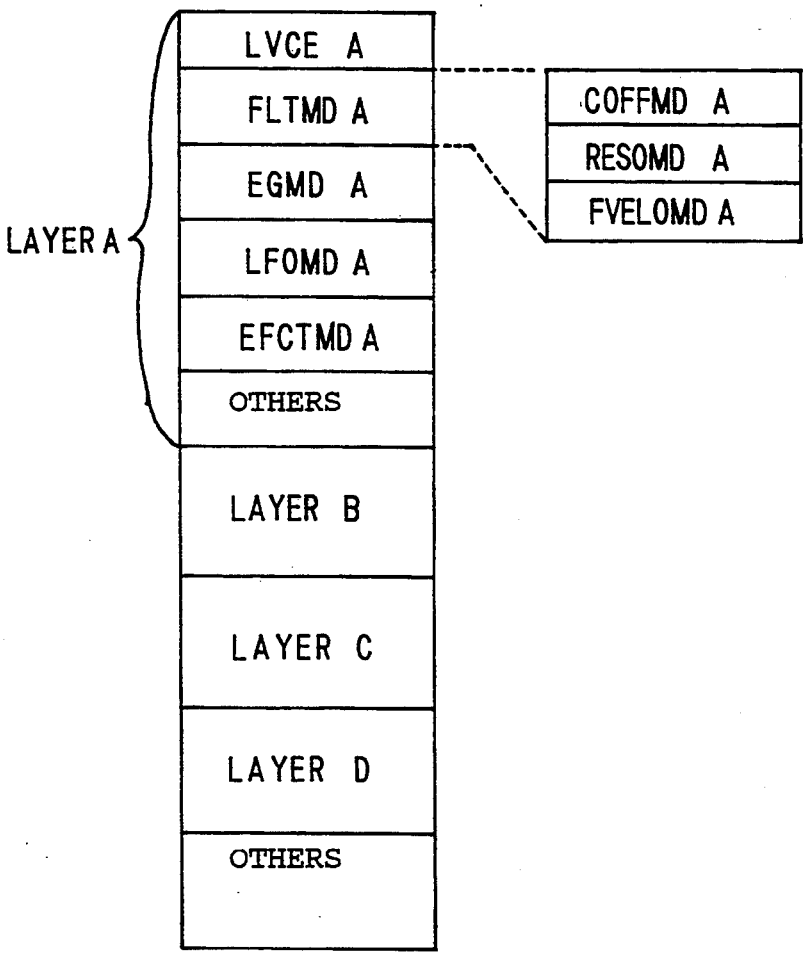
FIG. 4B is an illustration of data format of a set of layer data shown in FIG. 3A and 3B.

As shown in FIG. 4B, the sixteen sets of preset layer data LAYER PA1, LAYER PA2 . . . LAYER PD4 each are comprised of four sets of layer data LAYERA–LAYERD relating to four tone colors of four musical tone signals to be superimposed or mixed and other data. Other data are common control data for the four musical tone signals such as data for controlling total volume of four superimposed musical tone signals. The four sets of layer data LAYERA–LAYERD each are comprised of index data LVCEA–LVCED for respectively indexing one of plural sets of voice data, a plurality sets of data FLTMDA–FLTMDD, EGMDA–EGMDD, LFOMDA–LFOMDD, EFCTMDA–EFCTMDD for respectively modifying the parameters FLTPAR, EGPAR, LFOPAR, EFCTPAR included in the designated set of voice data and other data such as data for respectively controlling volume levels of musical tone signals to be superimposed. Each set of data FLTMDA–FLTMDD, EGMDA–EGMDD, LFOMDA–LFOMDD, EFCTMDA–EFCTMDD are further comprised of various data respectively. For example, the set of data FLTMDA–FLTMDD are comprised of data COFFMDA–COFFMDD, RESOMDA–RESOMDD, FVELOMDA–FVELMDD for respectively modifying the data COFF, RESO, FVELO included in the designated set of voice data.

Figure 3B:
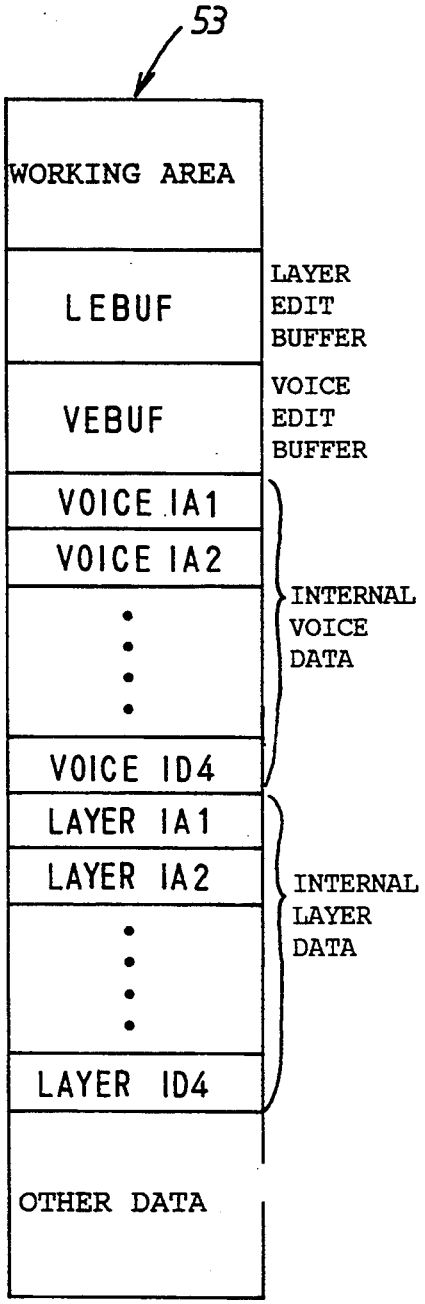
FIG. 3B is an illustration of a memory map of RAM shown in FIG. 1.

The 53 is divided into a working area for memorizing various variables during execution of the control programs, two edit buffer areas LEBUF, VEBUF for respectively editing the layer data and voice data, data memory area for memorizing plural sets of internal voice data VOICE IA1, VOICE IA2 . . . VOICE ID4 and plural sets of internal layer data LAYER IA1, LAYER IA2 . . . LAYER ID4 corresponding with each combination of the bank switches BSWA–BSWD and the number switches NSW1–NSW4 and other data memory area for memorizing other data such as data for controlling a total volume level of mixed musical tone signals as shown in FIG. 3B. Formats of the data memorized in the edit buffer area LEBUF, VEBUF are respectively the same as ones of the preset layer data LAYER PA1, LAYER PA2 . . . VOICE PD4 and the preset voice data VOICE PA1, VOICE PA2 . . . VOICE PD4 (see FIGS. 4A, 4B). Formats of the internal voice data VOICE IA1, VOICE IA2 . . . VOICE ID4 and internal layer data LAYER IA1, LAYER IA2 . . . LAYER ID4 are also respectively the same as ones of the preset voice data VOICE PA1, VOICE PA2 . . . VOICE PD4 and preset layer data LAYER PA1, LAYER PA2 . . . LAYER PD4.

Hereinafter, the operation of the electronic musical instrument will be described with reference to the flow charts. When a power switch is closed, the CPU 51 is activated to initiate execution of a main program at step 100 in FIG. 5 and repeatedly executes processing at steps 102–105 after initialization at step 101. At step 102, CPU 51 inputs data indicative of key depression condition (or key-release condition) and key touch accompanied by the key depression from the key board 10 and also inputs data indicative of ON-OFF condition of various switches on the operation panel 20, thereby detecting operation events of keys and switches to set the various modes of the electronic musical instrument. At step 103, the CPU 51 executes a tone color set routine to determine tone colors of tone signals to be generated on a basis of the detected operation events and the modes of the electronic musical instrument. At step 104, the CPU 51 executes a tone generating control routine to control generation of musical tone signals based on the detected key depression or release event, the detected key touch and the modes of the electronic musical instrument. At step 105, the CPU 51 executes other processing to load external data recorded in the flexible disk into the RAM 53 through the flexible disk drive 60 responsive to the detected operation event of the load switch **24*f***.

Figure 6:
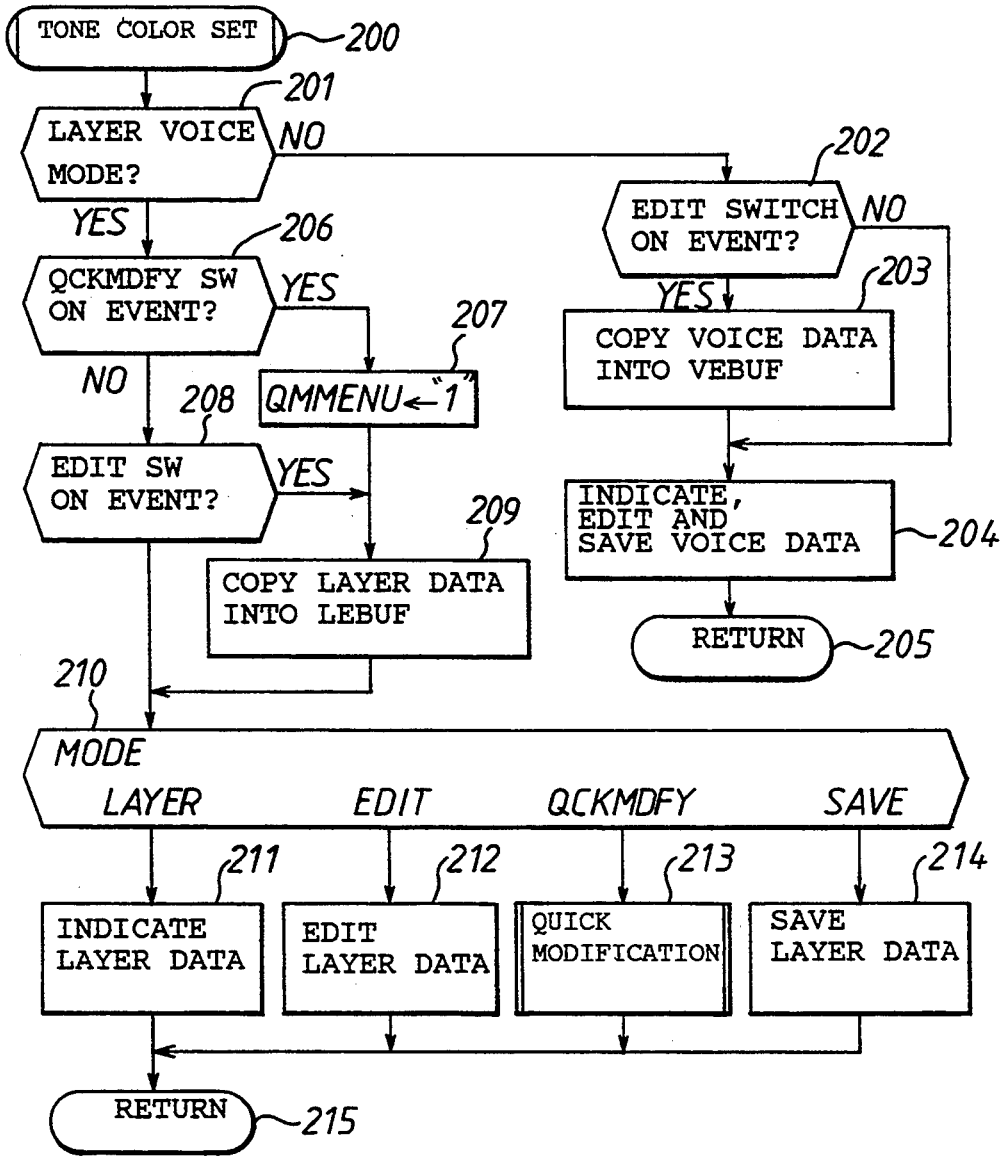
Figure 12:
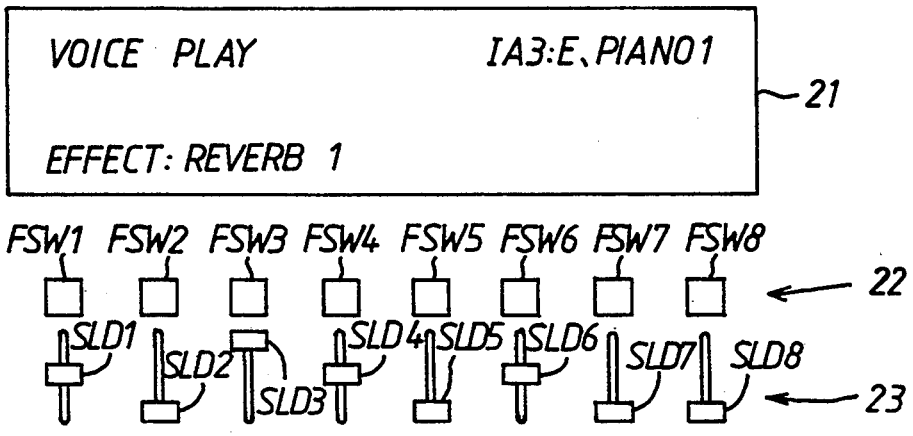
FIGS. 12 to 15 illustrate each indication on a display shown in FIG. 1.

As shown in FIG. 6, the CPU 51 initiates execution of the tone color set routine at step 200 and determines at step 201 whether the electronic musical instrument is set to the layer voice mode or not. The layer voice mode is set by operation of the layer switch **24*a*, and the single voice mode is set as another mode of the electronic musical instrument by operation of the voice switch 24*b*. If the electronic musical instrument is set to the single voice mode, the CPU 51 determines a "NO" answer at step 201 and causes the program to proceed to steps 202–204. Under a condition where the edit switch 24*c* is not operated, the CPU 51 selects a tone color of a musical tone signal to be generated at the single voice mode based on the operation of preset switch 25, internal switch 26, bank switches 27*a* (BSWA–BSWD) and number switches 28 (NSW1–NSW4) and indicates the name of selected tone color and others. For example, when the internal switch 26, bank switch BSWA and number switch NSW3 are operated or turned on, the internal voice data VOICE IA3 memorized in the RAM 53 are designated as tone control data for selected tone color, and the name of the selected tone color (for example, ELECTRIC PIANO 1) and the name of an effect accompanied by the selected tone color (for example, REVERBERATION 1) are indicated on the screen of display 21 as shown in FIG. 12**.

The edit switch **24*c* is operated to modify one of thirty-two sets of preset and internal voice data (For example, internal voice data VOICE IA3). The function switches FSW1–FSW8 and slide switches SLD1–SLD8 are operated by the player to modify a set of designated voice data (VOICE IA3). Thus, the CPU 51 determines at step 202 a "YES" answer in response to the operation of edit switch 24*c* and causes the program to proceed to step 203. At step 203, the CPU 51 copies one of thirty-two sets of internal voice data (for example, VOICE IA3) into the edit buffer area VEBUF, and edits or modifies at step 204 the copied data in the edit buffer area LEBUF in response to operation of function switches FSW1–FSW8 and slide switches SLD1–SLD8. The edited data are saved into the RAM 52 and/or the external flexible disk by the operation of save switch 24*e*, bank switches BSWA–BSWD and number switches NSW1–NSW4. After processing at step 204, the CPU 51 finishes execution of the tone color set routine at step 205**.

Figure 13:
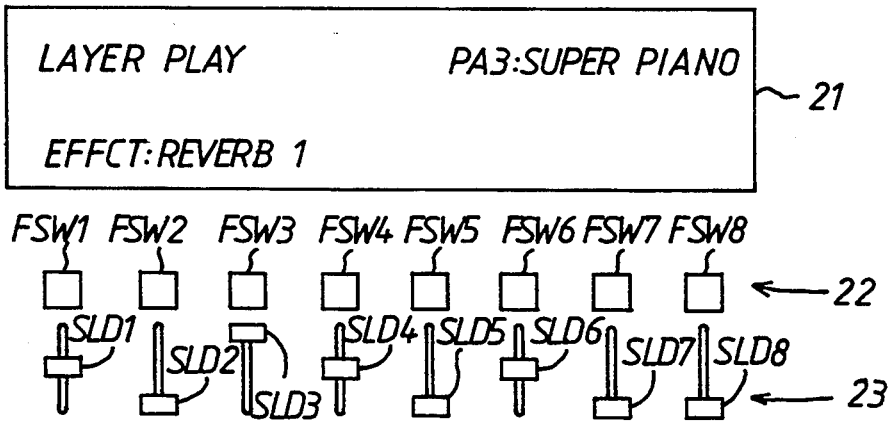

If the electronic musical instrument is set to the layer voice mode, the CPU 51 determines a "YES" answer at step 201 and causes the program to proceed to step 206–214. Under a condition where the edit switch **24*c*, quick modification switch 24*d* and save switch 24*e* are not operated, the CPU 51 selects a tone color of a tone signal superimposed by four musical tone signals to be generated at the layer voice mode based on the operation of preset switch 25, internal switch 26, bank switches 27*a* (BSWA–BSWD) and number switches 28 (NSW1–NSW4) and indicates the name of a selected tone color and others on the screen of display 21. For example, when the preset switch 26, bank switch BSWA and number switch NSW3 are operated or turned on, the preset voice data LAYER PA3 memorized in the ROM 52 are designated as tone control data for the selected tone color and, the name of the selected tone color (for example, SUPER PIANO) and the name of an effect accompanied by the selected tone color (for example, REVERBERATION 1) are indicated on the screen of display 21 as shown in FIG. 13**.

The edit switch **24*c* is operated to modify one of thirty-two sets of preset and internal layer data (for example, preset layer data LAYER PA3). The function switches FSW1–FSW8 and slide switches SLD1–SLD8 are operated by the player to modify a designated set of the layer data (LAYER PA3). In this instance, the CPU 51 determines at step 208 a "YES" answer in response to the operation of edit switch 24*c* and causes the program to proceed to step 209. At step 209, the CPU 51 copies one of thirty-two sets of layer data (for example, LAYER PA3) into the edit buffer area LEBUF data. After processing at step 209, the CPU 51 causes the program to proceed to step 212 by processing at step 210. At step 212, the CPU 51 edits or modifies the copied data in the edit buffer area LEBUF based on operation of function switches FSW1–FSW8 and slide switches SLD1–SLD8. In this instance, if the save switch is operated, the CPU 51 causes the program to proceed to step 214. At step 214, the CPU 51 saves the edited data into a desired area of the RAM 52 and/or the external flexible disk under designation by the bank switches BSWA–BSWD and number switches NSW1–NSW4. After processing at step 214, the CPU 51 finishes execution of the tone color set routine at step 215**.

At the layer voice mode, if the quick modification switch **24*d* is operated, the CPU 51 determines a "YES" answer at step 206 and causes the program to proceed to step 207. At the step 207, the CPU 51 sets a flag QMMENU to "1" and copies the layer data into the edit buffer area LEBUF at step 209 as described above. After processing at step 209, the CPU 51 causes the program to proceed to step 213 by process of processing at step 210 and executes a quick modification routine at step 213**.

Figure 7:
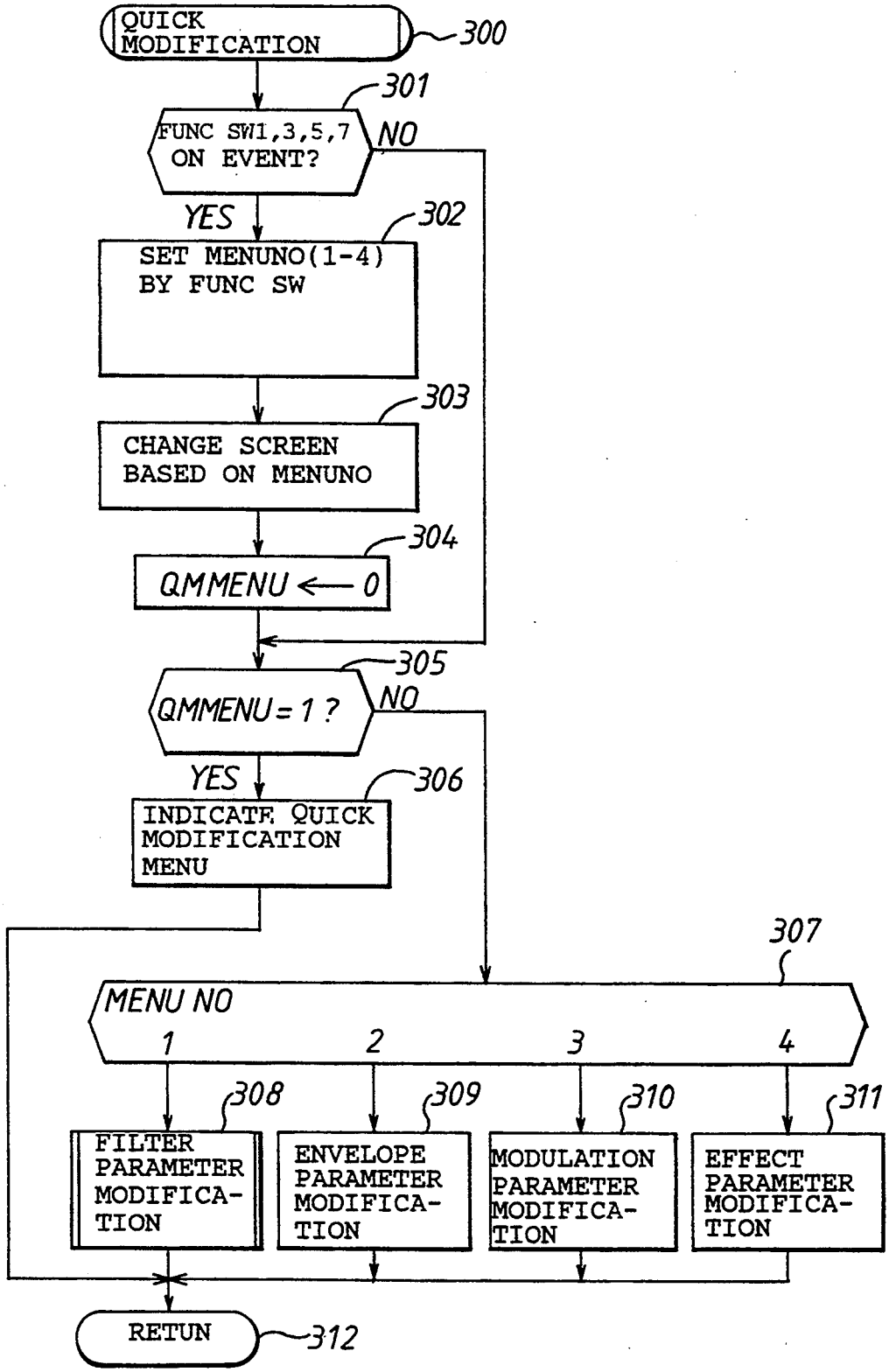
Figure 14:
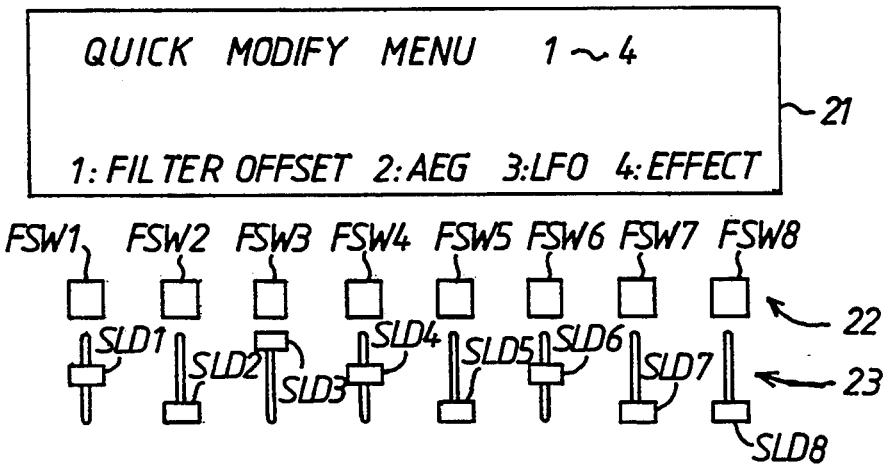

As shown in FIG. 7, the CPU 51 initiates execution of the quick modification routine at step 300 and determines at step 301 whether any one of the function switches FUNC SW1, FUNC SW3, FUNC SW5, FUNC SW7 has been operated or not. If any one of function switches FUNC SW1, FUNC SW3, FUNC SW5, FUNC SW7 is not operated immediately after operation of the quick modification switch 24*d*, the CPU 51 determines a "NO" answer at step 301 and causes the program to proceed to step 305. At step 305, the CPU 51 determines wherever the flag QMMENU is "1" or not. When the flag QMMENU is set to "1" by processing at step 207 as described above, the CPU 51 determines a "YES" answer at step 305 and causes the program to proceed to step 306. At step 306, the CPU 51 controls the display 21 to indicate a quick modification menu for selection of data to be modified on its screen as shown in FIG. 14. In this state, the data FLTMDA-FLTMDD, EGMDA-EGMDD, LFOMDA-LFOMDD, EFCTMDA-EFCTMDD belonging to the first to fourth sets of layer data LAYERA--LAYERD memorized in the edit buffer or LEBUF are selected for modification by operation of the function switches FSW1, FSW3, FSW5, FSW7 positioned to correspond with each position of menu numbers 1-4 indicated on the screen.

Figure 15:
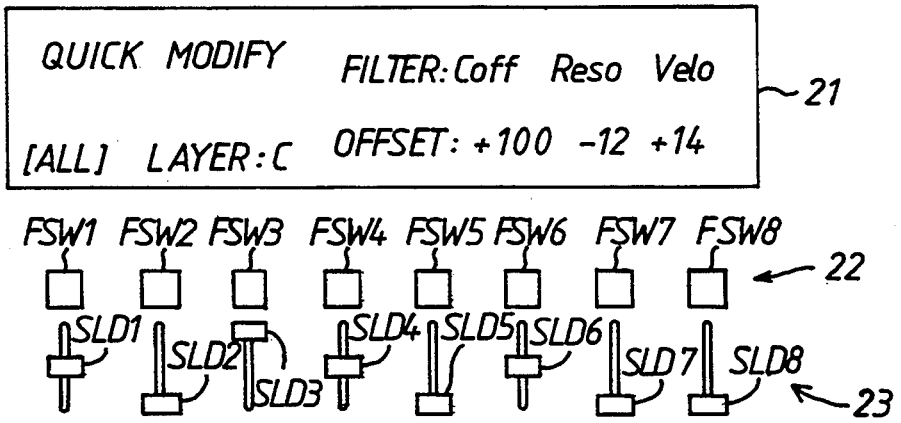

If any one of the function switches FSW1, FSW3, FSW5, FSW7 is operated, the CPU 51 determines a "YES" answer at step 301 and causes the program to proceed to step 302, 303. The CPU 51 sets at step 302 a flag MENUNO to a value among values 1-4 based on the operated function switches FSW1, FSW3, FSW5, FSW7 and controls the display 21 at step 303 to change the screen into an indication state corresponding with the flag MENUNO. Thus, element names controlled by each set of data belonging to the data FLTMDA-FLTMDD, EGMDA-EGMDD, LFOMDA-LFOMDD, EFCTMDA-EFCTMDD are respectively indicated on the screen, and each set of data values are also indicated in the form of offset values on the screen. For example, if the function switch FSW1 is operated, information related to the data COFFMDA (or COFFMDB-COFFMDD), RESOMDA (or RESOMDB-RESOMDD), FVELOMDA (or FVELOMDB-FVELOMDD) belonging to the data FLTMDA-FLTMDD is indicated on the screen as shown in FIG. 15. The display 21 indicates any one of capital letters "A", "B", "C", "D" indicative of the first to fourth sets of layer data LAYERA-LAYERD on the lower left portion of the screen. The capital letter "A" is indicated immediately after any one of the function switches FSW1, FSW3, FSW5, FSW7 has been operated for selection of the flag MENUNO, and thereafter the indicated capital letter will be changed into one of capital letters "A", "B", "C", "D" at each time when one of the function switches FSW1, FSW3, FSW5, FSW7 is operated.

After processing at step 303, the CPU 51 sets the flag QMMENU to "0" at step 304. Thus, the CPU 51 determines a "NO" answer at step 305 and causes the program to proceed to step 307-311. If the flag MENUNO is "1", the CPU 51 modifies at step 308 the data FLTMDA-FLTMDD based on operation of the function switches 22 and slide switches 23. If the flag MENUNO is "2", the CPU 51 modifies at step 309 the data EGMDA-EGMDD based on operation of both the switches 22, 23. If the flag MENUNO is "3", the CPU 51 modifies at step 310 the data LFOMDA-LFOMDD based on operation of both the switches 22, 23. If the flag MENUNO is "4", the CPU 51 modifies at step 311 the data EFCTMDA-EFCTMDD based on operation of both the switches 22, 23.

Figure 8:
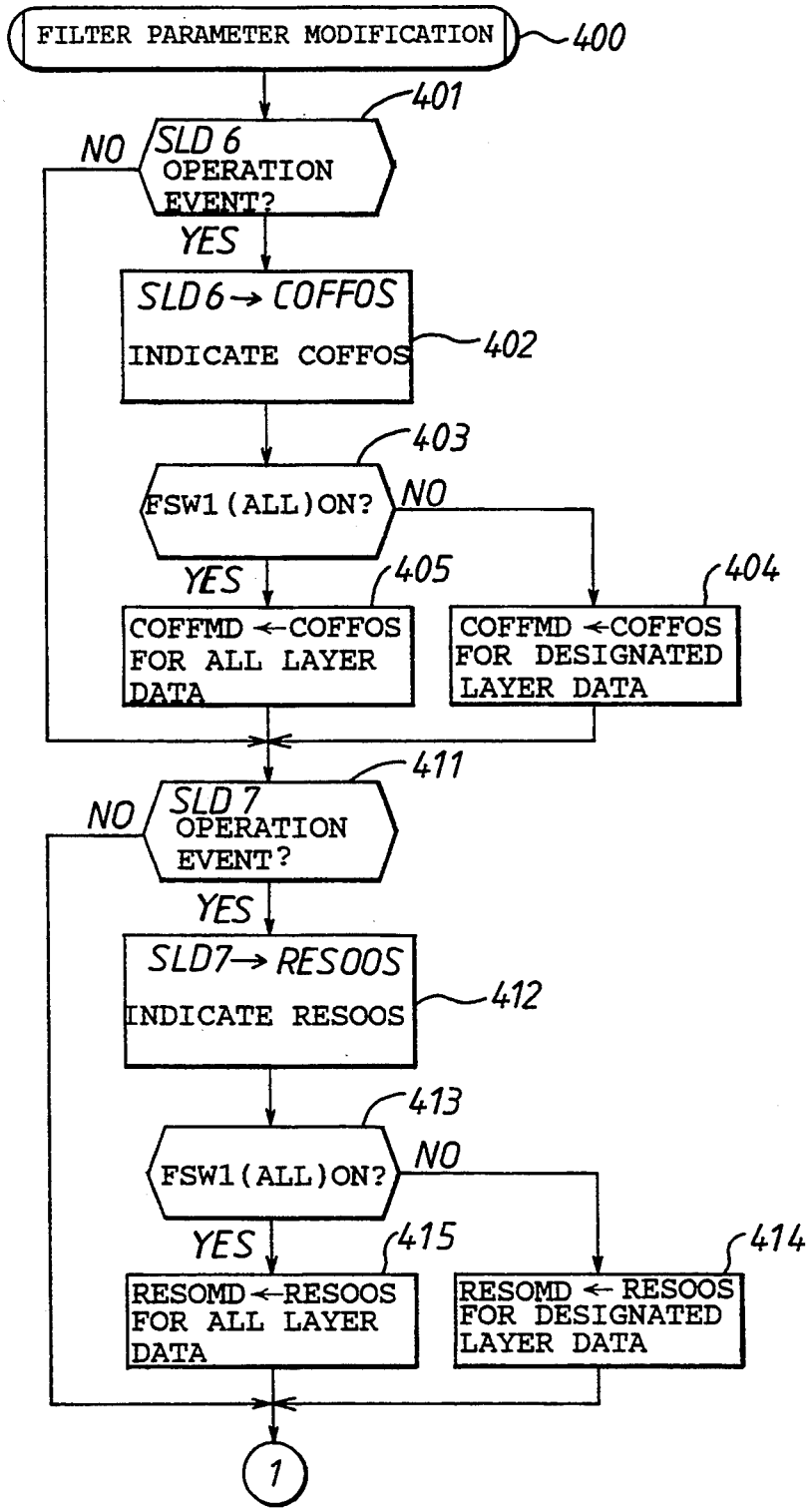
Figure 9:
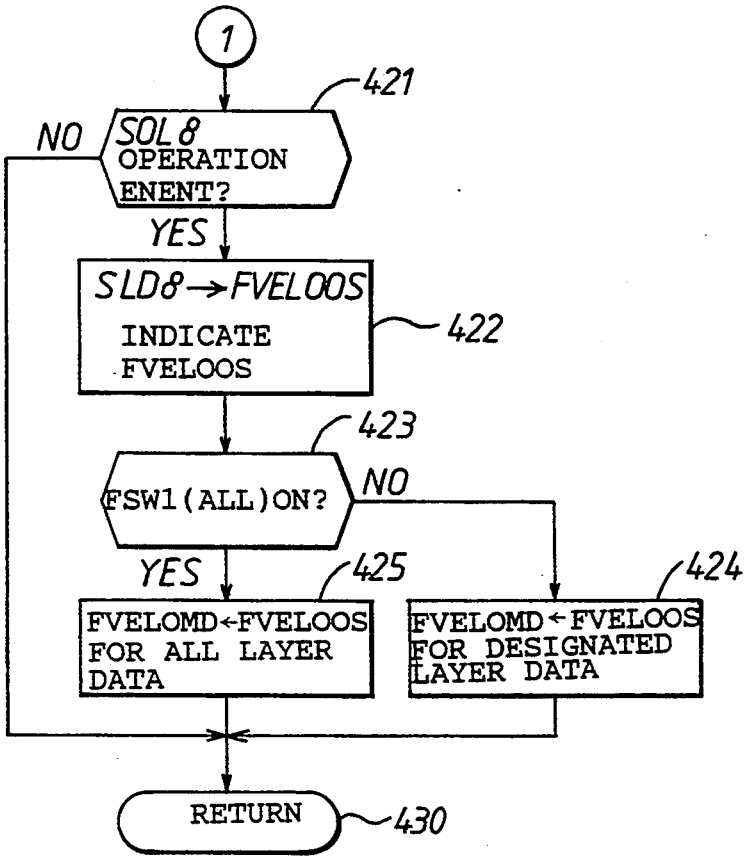

Hereinafter, only the filter parameter modification routine at step 308 will be described in detail, since the routines at step 308-311 are almost the same processing. As shown in FIG. 8, the CPU 51 initiates at step 400 execution of the filter parameter modification routine and determines at step 401, 411, 421 whether or not the slide switches SLD6-SLD8 have been operated. The slide switches SLD6-SLD8 are positioned to correspond with each position of the letters "Coff", "Reso", "Velo" abbreviated for the cut-off frequency, resonance sharpness and key touch sensitivity indicated on the screen as shown in FIG. 15. If any one of slide switches SLD6-SLD8 is not operated, the CPU 51 determines a "NO" answer respectively at step 401, 411, 421 and causes the program to proceed step 430 to finish execution of the filter parameter modification routine.

If the slide switches SLD6-SLD8 are operated, the CPU 51 determines a "YES" answer respectively at step 401, 411, 421 and causes the program to proceed to step 402, 412, 422. At step 402, 412, 422, the CPU 51 inputs the data indicative of knob positions of slide switches SLD6-SLD8 to temporarily set the inputted data as offset values COFFOS, RESOOS, FVELOOS for the cut-off frequency, resonance sharpness and key touch respectively sensitivity and to control the display 21 to indicate the offset values COFFOS, RESOOS, FVELOOS of the screen. At the following step 403, 413, 423, the CPU 51 determines whether the function switch FSW1 is operated or not. In this instance, the function switch FSW1 is positioned to correspond with letters "ALL" indicated on the screen as shown in FIG. 15 and used for commonly and simultaneously modifying all the data COFFMDA-COFFMDD, RESOMDA-RESOMDD, FVLEOMDA-FVELMDD belonging to the first to fourth sets of layer data LAYERA-LAYERD.

If the function switch FSW1 is not operated, the CPU 51 determines a "NO" answer respectively at step 403, 413, 423 and causes the program to proceed to step 404, 414, 424. At step 404, 414, 424, the CPU 51 changes each set of the data values COFFMDA (or COFFMDB-COFFMDD), RESOMDA (or RESOMDB-RESOMDD), FVELOMDA (or FVELOMDB-FVELOMDD) belonging to the designated layer data LAYERA (LAYERB-LAYERD) which corresponds the capital letter A-D indicated in the lower left portion of screen (see FIG. 15) into the offset values COFFOS, RESOOS, FVELOOS. If the function switch FSW1 is operated, the CPU 51 determines a "YES" answer respectively at step 403, 413, 423 and causes the program to proceed to step 405, 415, 425. At step 405, 415, 425, the CPU 51 changes simultaneously all the data values COFFMDA-COFFMDD, RESOMDA-RESOMDD, FVELOMDA-FVELOMDD belonging to the first to fourth sets of layer data LAYERA-LAYERD into the offset values COFFOS, RESOOS, FVELOOS. As a result, the player can easily and quickly edit or modify the data FLTMDA-FLTMDD, EGMDA-EGMDD, LFOMDA-LFOMDD, EFCTMDA-EFECTMDD belonging to the first to fourth sets of layer data LAYERA-LAYERD.

Figure 5:
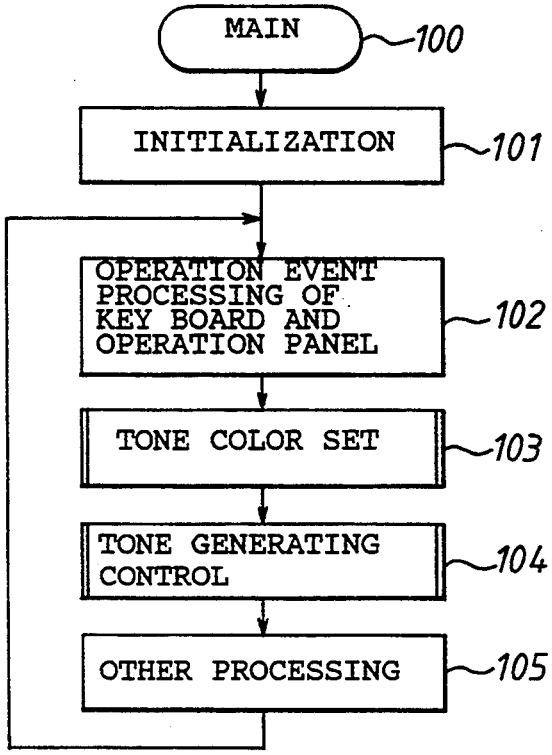
FIGS. 5 to 11 illustrate flow charts of program executed by a microcomputer shown in FIG. 1.

Hereinafter, the tone generating routine of step 104 shown in FIG. 5 will be described in detail. The CPU 51 initiates execution of the tone generating routine at step 500 shown in FIG. 10 and determines at step 501 whether any one of keys of the key board 10 is depressed or not. If any one of keys is not depressed, the CPU 51 determines a "NO" answer at step 501 and causes the program to proceed to step 502. At step 502, the CPU 51 executes processing for stopping tone production based on key release and executes other processing at step 506. After processing at step 502, the CPU 51 finishes the tone generating routine at step 511.

If any one of keys on the keyboard 10 is depressed, the CPU 51 determines a "YES" answer at step 501 and causes the program to proceed to step 503, 507. The CPU 51 determines at step 503 whether the electronic musical instrument is set to the single voice mode or not, and determines at step 507 whether the electronic musical instrument is set to the layer voice mode or not. In this instance, the electronic musical instrument is set to either one of both the modes under operation of the voice switch **24*b* or the layer switch 24*a*. If the electronic musical instrument is set to the single voice mode, the CPU 51 determines a "YES" answer at step 503 and causes the program to proceed to step 504. At step 504, the CPU 51 determines whether or not the player is editing or modifying the preset voice data VOICE PA1–VOICE PD4 or internal voice data VOICE IA1–VOICE ID4 (corresponding with the processing of step 202–204 shown in FIG. 6). If the player is not editing the data VOICE PA1–VOICE PD4, VOICE IA1–VOICE ID4, the CPU 51 determines a "NO" answer at step 504 and causes the program to proceed to step 505. At step 505, the CPU 51 controls generating of a musical tone signal based on the designated preset or internal voice data. This is to say, the CPU 51 assigns a depressed key to one of available musical tone signal producing channels and applies channel number data indicative of the assigned channel, tone pitch data indicative of the depressed key of key board 10, key touch data indicative of key touch and key-on signal to the musical tone signal producer 40. The data WAVE, the parameters FLTPAR (the data COFF, RESO, FVELO and others), EGPAR, LOFPAR, EFECTPAR and other data belonging to the designated preset or internal voice data are also applied to the musical tone signal producer 40**.

In the musical tone signal producer 40, the tone wave form generator circuit 41 inputs the data WAVE and tone pitch data to generate a tone wave form signal designated by the data WAVE at a rate designated by the tone pitch data. The filter circuit 42 inputs the parameters FLTPAR to modify harmonic composition of the tone wave form signal applied from the tone wave form generator circuit 41 by the parameter FLTPAR. The envelope control circuit 43 inputs the parameter EGPAR and key touch data to control amplitude envelope of the tone wave form signal applied from the filter circuit 42 by the parameter EGPAR and key touch data. The effector circuit 44 inputs the parameters LFOPAR, EFCTPAR to provide the tone wave form signal applied from the envelope control circuit 43 with a low frequency modulation effect based on the parameters LFOPAR and to provide the tone wave form signal with other musical effect such as a reverberation effect based on the parameters EFCTPAR. The volume control circuit 45 inputs the other data such as volume level control data to control mixing ratio and total volume of the tone wave form signal applied from the effector circuit 44. The channel number data are also applied to the tone wave form generator circuit 41, filter circuit 42, envelope control circuit 43, effector circuit 44 and volume control circuit 45 to designate a time division channel for modifying the tone wave form signals in the circuits 41–45.

The tone wave form signal generated and modified at the circuits 41–45 is applied to D/A converter 46. The D/A converter 46 converts the applied digital type of tone wave form signal into the analogue type of tone wave form signal to apply the converted signal to speaker 48 through the amplifier 47. The speaker 48 sounds a musical tone corresponding with the applied tone wave form signal. In response to key depression of the key board 10, the electronic musical instrument sounds a musical tone with a tone color defined by any one of the plural sets of preset voice data VOICE PA1, VOICE PA2 . . . VOICE PD4 memorized in the ROM 52 and the plural sets of internal voice data VOICE IA1, VOICE IA2 . . . VOICE ID4 memorized in the RAM 53.

If the player is editing the preset voice data VOICE PA1–VOICE PD4 or internal voice data VOICE IA1–VOICE ID4, the CPU 51 determines a "YES" answer at step 504 and causes the program to proceed to step 506. At step 506, the CPU 51 applies the voice data memorized in the edit buffer VEBUF of the RAM 53 to the musical tone signal producer 40. The channel number data, tone pitch data, key touch data and key-on signal are also applied to the musical tone signal producer 40. Thus producer 40 produces the tone wave form signal in the same way as describe above. In this instance, the electronic musical instrument responds to key depression of the key board 10 to sound a musical tone with a tone color defined by the voice data memorized in the edit buffer VEBUF of the RAM 53. In other words, the tone color of the sounded musical tone is defined by the voice data which modify one of plural sets of the preset voice data VOICE PA1, VOICE PA2 . . . VOICE PD4 memorized in the ROM 52 and the internal voice data VOICE IA1, VOICE IA2 . . . VOICE ID4 memorized in the RAM 53.

If the electronic musical instrument is set to the layer voice mode, the CPU 51 determines a "YES" answer at step 507 and causes the program to proceed to step 508. At step 508, the CPU 51 determines whether or not the player is editing or modifying (including quick modifying) the preset layer data LAYER PA1–LAYER PD4 or internal layer data LAYER IA1–LAYER ID4 (corresponding with the processing of step 206–209, 212, 213 shown in FIG. 6). If the player is editing the data LAYER PA1–LAYER PD4, LAYER IA1–LAYER ID4, the CPU 51 determines a "YES" answer at step 508 and causes the program to proceed to step 509. At step 509, the CPU 51 executes a modified tone generating routine.

Figure 11:
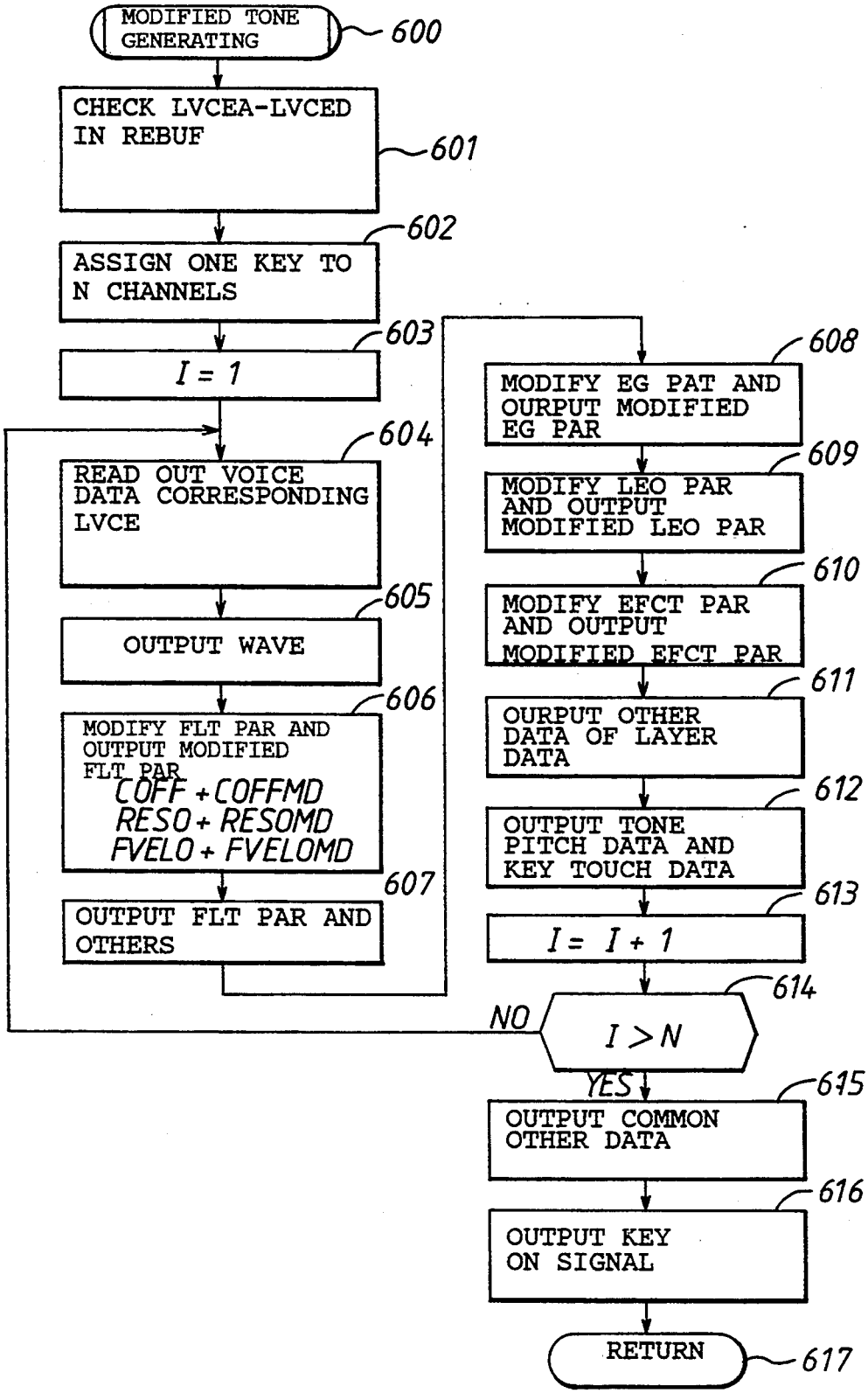

As shown in FIG. 11, the CPU 51 initiates execution of the modified tone generating routine at step 600 and reads out the data LVCEA–LVCED from the edit buffer LEBUF of the RAM 53 to determine whether or not the data LVCEA–LVCED each are identical with the data for designating any one of the tone wave form signals memorized in the tone generator circuit 41. In this instance, some of the data LVCEA–LVCED is set as a particular value (for example "0") which does not designate any tone wave form signals to be mixed. Additionally the number of tone wave form signals to be mixed is counted and the counted number is set as a value N at step 601. At the following step 602, the CPU 51 searches N available musical tone signal producing channels to assign one depressed key to the searched N channels.

After processing at 602, the CPU 51 sets a variable I to "1" at step 603 and repeatedly executes the circular processing at step 604–614 until the variable I becomes more than the value N under control of adding "1" to the variable I at step 613. During the circular processing, the CPU 51 reads out the index data LVCEA (LVCEB–LBCED) included in the layer data designated by the variable I (1–N) from the edit buffer LEBUF of RAM 53 and reads out one set of voice data designated by the read out index data LVCEA (LVCEB–LBCED) among the thirty-two sets of preset and internal voice data VOICE PA1–VOICE PD4, VOICE IA1–VOICE ID4 from the ROM 52 or RAM 53 at step 604. The CPU 51 applies the data WAVE belonging to the read out voice data and a channel number data indicative of one of the N assigned channels to the tone wave generator circuit 41 at step 605. The CPU 5l adds the data COFFMDA (or COFFMDB–COFFMDD), RESOMDA (or RESOMDB–RESOMDD), FVELOMDA (or FVELOMDB–FVELMDD) to the data COFF, RESO, FVELO respectively for modifying the data COFF, RESO, FVELO and applies the results of addition to the filter circuit 42 with the channel number data at step 606. The data COFFMDA (COFFMDB–COFFMDD), RESOMDA (RESOMDB–RESOMDD), FVELOMDA (FVELOMDB–FVELMDD) are applied as the filter modification data FLTMDA (FLTMDB–FLTMDD) belonging to the layer data LAYERA (LAYERB–LAYERD), and the layer data LAYERA (LAYERB–LAYERD) are designated by the variable I to be read out from the edit buffer LEBUF. The data COFF, RESO, FVELO are included in the parameters FLTPAR belonging to the read out voice indexed by the index data LVCEA (LVCEB–LBCED). At the following step 607, other data included in the parameters FLTPAR are also applied to the filter circuit 42 with the channel number data.

After processing at step 607, the CPU 51 modifies the parameters EGPAR, LFOPAR, EFCTPAR by the data EGMDA (EGMDB–EGMDD), LFOMDA (LFOMDB–LFOMDD), EFCTMDA (EFCTMDB–EFCTMDD) to apply results of the modification to the envelope control circuit 43 and effector circuit 44 with the channel number data in the same way as described above at step 608–610. The parameters EGPAR, LFOPAR, EFCTPAR belong to the read out voice data indexed by the index data LVCEA (LVCEB–LBCED). The data EGMDA (EGMDB–EGMDD), LFOMDA (LFOMDB–LFOMDD), EFCTMDA (EFCTMDB–EFCTMDD) belong to the layer data LAYERA (LAYERB–LAYERD), and the layer data LAYERA (LAYERB–LAYERD) are designated by the variable I to be read out from the edit buffer LEBUF. At the following step 611, the CPU 51 applies other data indicative of volume levels (mixing levels) for each musical tone signal to the volume control circuit 45 with the channel number data. The other data also belongs to the layer data LAYERA (LAYERB–LAYERD). At step 612, the tone pitch data indicative of the depressed key on key board 10 and key touch data indicative of key touch are also applied to the circuits 41–45 of the musical tone signal producer 40 with the channel number data. When the various control data for all N musical tone signals have been applied to the musical tone signal producer 40 as described above, the CPU 51 determines a "YES" answer at step 614 and causes the program to proceed to step 615, 616. At step 615, the CPU 51 applies other data common to the first to fourth sets of layer data LAYERA–LAYERD such as the data indicative of total volume level of the mixed musical tone signals to the musical musical tone signal producer 40. At step 616, the CPU 51 applies the key-on signal to the musical tone signal producer 40 with the N sets of channel number data indicative of the N assigned channels. After processing at step 616, the CPU 51 finishes execution of the modified tone generating routine at step 617.

The musical tone signal producer 40 simultaneously produces N musical tone signals in the same way as the single voice mode and mixes or superimposes the N musical tone signals to simultaneously sound them as one musical tone signal from the speaker 48. In this instance, the tone colors of the musical tone signals are controlled by the parameters FLTPAR, EGPAR, LFOPAR, EFCTPAR which are modified by modification data FLTMDA–FLTMDD, EGMDA–EGMDD, LFOMDA–LFOMDD, EFCTMDA–EFCTMDD. The parameters FLTPAR, EGPAR, LFOPAR, EFCTPAR belong to each voice data of preset voice data VOICE PA1–VOICE PD4 memorized in the ROM 52 and internal voice data VOICE IA1–VOICE ID4 memorized in the RAM 53. THe modification data FLTMDA–FLTMDD, EGMDA–EGMDD, LFOMDA–LFOMDD, EFCTMDA–EFCTMDD are memorized in the edit buffer LEBUF of the RAM 53.

Figure 10:
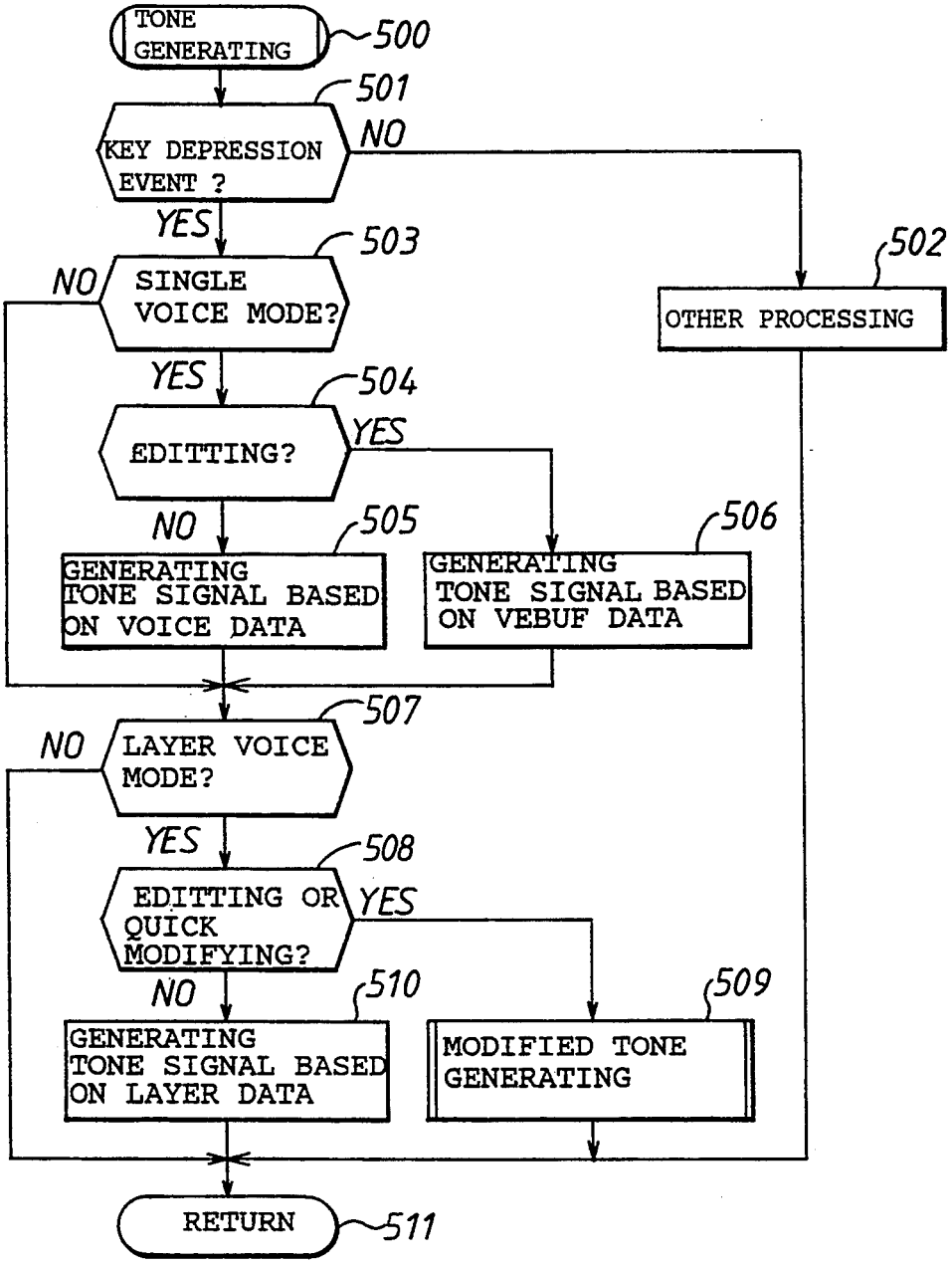

If the player is not editing or modifying (including quick modifying) the preset layer data LAYER PA1–LAYER PD4 or the internal layer data LAYER IA1–LAYER ID4 in a condition where the electronic musical instrument is set to the layer voice mode, the CPU 51 determines a "NO" answer at step 508 of FIG. 10 and causes the program to proceed to step 510. At step 510, the CPU 51 causes the musical tone signal producer 40 to produce musical tone signals based on the selected layer data. In this instance, any one set of layer data among the plural sets of preset layer data LAYER PA1–LAYER PD4 memorized in the ROM 52 and the plural sets of internal layer data LAYER IA1–LAYER ID4 memorized in the RAM 53 are selected for control of the tone colors in stead of the layer data memorized in the edit buffer LEBUF of RAM 53, The index data LVCEA–LBCED belonging to the selected layer data designate four sets of voice data among the plural sets of preset and internal voice data VOICE PA1–VOICE PD1, VOICE IA1–VOICE ID4, and the parameters FLTPAR, EGPAR, LFOPAR, EFCTPAR belonging to the designated sets of voice data are modified by the modification data FLTMDA–FLTMDD, EGMDA–EGMDD, LFOMDA–LFOMDD, EFCTMDA–EFCTMDD belonging to the selected layer data. The data WAVE and the modified parameters FLTPAR, EGPAR, LFOPAR, EFCTPAR are applied to the musical tone signal producer 40 for control of the tone colors.

As described above, when the electronic musical instrument is set to the single voice mode, a single musical tone signal is produced on basic of any one of the plural sets of preset voice data VOICE PA1–VOICE PD4 memorized in the ROM 52 and the plural sets of internal voice data VOICE IA1–VOICE ID4 memorized in the RAM 53, and a musical tone corresponding with the produced musical tone signal is sounded. When the electronic musical instrument is set to the layer voice mode, any one of the plural sets of preset and internal voice data VOICE PA1–VOICE PD4, VOICE IA1–VOICE ID4 is indexed by the index data LVCEA–LVCED. The index data LVCEA–LVCED are included in the first to fourth sets of layer data LAYERA–LAYERD which includes a selected set of layer data among the plural sets of preset layer data LAYER PA1–LAYER PD4 memorized in the ROM 52, the plural sets of internal layer data LAYER IA1–LAYER ID4 memorized in the RAM 53 and a set of layer data memorized in the edit buffer LEBUF of the RAM 53. The parameters FLTPAR, EGPAR, LFOPAR, EFCTPAR belonging to the designated voice data are modified by the modification data FLTMDA–FLTMDD, EGMDA–EGMDD, LFOMDA–LFOMDD, EFCTMDA–EFCTMDD belonging to the first first to fourth sets of layer data LAYERA–LAYERD. In this instance, a plurality of musical tone signals are produced on a basis of the modified parameters FLTPAR, EGPAR, LFOPAR, EFCTPAR, and the produced musical tone signals are mixed or superimposed to be sounded as a single musical tone. As a result, when the musical tone signals are produced at the layer voice mode, tone colors of a plurality of musical tone signals to be mixed can be individually and delicately modified without editing the the preset and internal voice data VOICE PA1–VOICE PD4, VOICE IA1–VOICE ID4 prepared for a single voice. In addition, capacity of a memory for memorizing the modification data FLTMDA–FLTMDD, EGMDA–EGMDD, LFOMDA–LFOMDD, EFCTMDA–EFCTMDD can be reduced since the modification data are indicated in the form of offset values.

Although in the foregoing embodiment a tone color of a musical tone signal generated at the single voice mode is fixed, the tone color may be modified in the same way as that at the layer voice mode. In this instance, basic data for determining a basic tone color of a musical tone signal at the single voice mode and modification data for modifying the basic data are memorized in a memory. The basic data are modified by the modification data to be used for producing a musical tone signal based on the modified basic data.

What is claimed is:

1. A tone color control apparatus for controlling a tone color of a musical tone signal produced at a musical tone signal producer, comprising:

first memory means for memorizing plural sets of tone color data for control of each tone color of plural different musical tone signals produced at said musical tone signal producer;

second memory means for memorizing plural sets of index data for indexing the memorized plural sets of the tone color data and for memorizing plural sets of modification data respectively corresponding with each set of the memorized index data;

selection means for simultaneously selecting a desired set of the memorized index data and a set of the memorized modification data corresponding with the desired set of the memorized index data;

means for reading out the desired set of the memorized index data and the set of the memorized modification data from said second memory means under control of said selection means and for reading out a set of the memorized tone color data indexed by the desired set of the read out index data from said first memory means; and modification means for modifying the set of the read out tone color data on a basis of the set of the read out modification data and for applying the set of the modified tone color data to said musical tone signal producer.

2. A tone color control apparatus for a musical tone signal producer as claimed in claim 1, further comprising edit means for editing the plural sets of modification data memorized in said second memory means.

3. A tone color control apparatus for a musical tone signal producer as claimed in claim 1, wherein said musical tone signal producer comprises a tone wave form generator for generating a tone wave form signal therefrom, a filter for modifying harmonic composition of the tone wave form signal, an envelope control circuit for controlling an amplitude envelope of the tone wave form signal and an effector for applying a musical effect to the tone wave form signal, wherein the tone color data memorized in said first memory means include wave form designation data to be applied to said tone wave form generator for designating the tone wave form signal, filter control data to be applied to said filter for determining a frequency characteristic thereof, envelope control data to be applied to said envelope control circuit for determining a shape of an amplitude envelope of the tone wave form signal and effect control data to be applied to said effector for control of the musical effect applied to the tone wave form signal, and wherein the modification data memorized in said second memory means include data for modifying each of the filter control data, envelope control data and effect control data.

4. A tone color control apparatus for controlling each tone color of plural musical tone signals produced at a musical tone signal producer, comprising:

first memory means for memorizing plural sets of tone color data for control of each tone color of plural different musical tone signals produced at said musical tone signal producer;

second memory means for memorizing plural sets of layer data each including plural sets of index data for indexing the plural sets of memorized tone color data and plural sets of modification data respectively corresponding with each set of the index data;

selection means for selecting a desired set of the memorized layer data;

means for reading out the desired set of the memorized layer data from said second memory means under control of said selection means and for reading out a set of the memorized tone color data indexed by a set of the index data of the read out layer data from said first memory means; and modification means for modifying the set of the read out tone color data on a basis of a set of the modification data of the read out layer data and for applying the set of the modified tone color data to said musical tone signal producer.

5. A tone color control apparatus for a musical tone signal producer as claimed in claim 4, further comprising edit means for editing the plural sets of modification data memorized in said second memory means.

6. A tone color control apparatus for a musical tone signal producer as claimed in claim 5, wherein said edit means includes common edit means for commonly editing the plural sets of modification data of the layer data.

7. A tone color control apparatus for a musical tone signal producer designed to produce a single musical tone signal at a first mode and to produce a plurality of musical tone signals at a second mode, said tone color control apparatus comprising:

first memory means for memorizing plural sets of tone color data for control of each tone color of plural different musical tone signals produced at said musical tone signal producer;

second memory means for memorizing plural sets of layer data each including plural sets of index data for indexing the memorized plural sets of tone color data and plural sets of modification data respectively corresponding with each set of the index data;

selection means for selecting a desired set of the memorized plural sets of tone color data at the first mode of said musical tone signal producer and for selecting a desired set of the memorized plural sets of layer data at the second mode of said musical tone signal producer;

first reading means for reading out the desired set of the memorized tone color data from said first memory means under control said selection means to apply the read out tone color data to said musical tone signal producer at the first mode;

second reading means for reading out the desired set of the memorized layer data from said second memory means under control of said selection means and for reading out a set of the memorized tone color data indexed by a set of the index data of said read out layer data from said first memory means at the second mode of said musical tone signal producer; and modification means for modifying the set of the read out tone color data on a basis of a set of the modification data of the read out layer data and for applying the set of the modified tone color data to said musical tone signal producer.

8. A tone color control apparatus for a musical tone signal producer as claimed in claim 7, further comprising edit means for editing the plural sets of modification data memorized in said second memory means.

9. A tone color control apparatus for a musical tone signal producer as claimed in claim 8, wherein said edit means includes common edit means for commonly editing the plural sets of modification data of the layer data.

* * * * *